United States Patent [19]

Crépin

[11] 4,353,283

[45] Oct. 12, 1982

[54] FIRING TURRET FOR A VEHICLE, AND VEHICLE INCLUDING SUCH A TURRET

[76] Inventor: Roger Crépin, 173, bl. Haussmann, 75008 Paris, France

[21] Appl. No.: 143,998

[22] PCT Filed: Jul. 12, 1978

[86] PCT No.: PCT/FR78/00009

§ 371 Date: Aug. 10, 1979

§ 102(e) Date: Aug. 10, 1979

[87] PCT Pub. No.: WO79/00852

PCT Pub. Date: Nov. 1, 1979

[51] Int. Cl.[3] ..... F41F 21/06

[52] U.S. Cl. ..... 89/37 G; 89/41 T

[58] Field of Search ..... 89/37 G, 37 K, 41 T

[56] References Cited

U.S. PATENT DOCUMENTS

| | | | |
|---|---|---|---|
| 794,649 | 7/1905 | Ternström | 89/41 T |
| 2,178,291 | 10/1939 | Steuerlein | 89/37 G |
| 3,008,380 | 11/1961 | Cowley | 89/37.5 |
| 3,581,621 | 6/1971 | Bauer | 89/37 K |
| 3,688,638 | 9/1972 | Morris et al. | 89/41 T |

FOREIGN PATENT DOCUMENTS

| | | | |
|---|---|---|---|
| 348265 | 2/1922 | Fed. Rep. of Germany | 89/37 G |
| 377490 | 12/1939 | Italy | 89/37 G |

*Primary Examiner*—Stephen C. Bentley

*Attorney, Agent, or Firm*—Edwin E. Greigg

[57] ABSTRACT

A firing turret which can be oriented about its axis, permitting flat-trajectory or curved-trajectory firing of artillery projectiles. It includes a disc whose central portion includes an opening in the interior of which the cradle of the weapon can pivot; the disc is free to turn within a circular opening provided in the lateral wall of the turret. A turret of this kind may be used to equip an automotive or trailed vehicle.

15 Claims, 18 Drawing Figures

Fig-11a
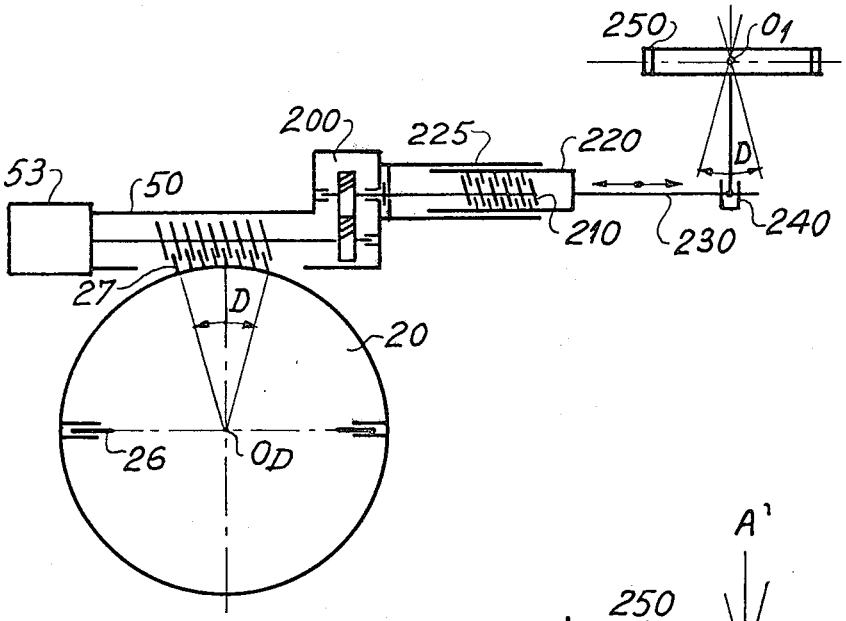
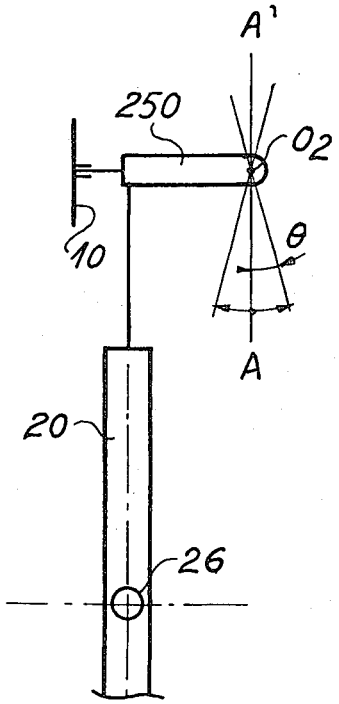
FIG.11b

FIRING TURRET FOR A VEHICLE, AND VEHICLE INCLUDING SUCH A TURRET

BACKGROUND OF THE INVENTION

The invention relates to the technical field of multiaxial aiming mechanisms. More particularly, the invention consists in a firing turret mounted on a mobile platform and, more specifically, to means which corrects the tilt angle of a weapon and of the optical sighting device thereof.

The invention as described below relates particularly, but not exclusively, to a firing turret for armored vehicles, but it is to be understood that the means described are equally suitable for a turret susceptible of being inclined and for which it is desired to maintain the horizontality of the pivoting trunnions of the weapon or of the barrel cradle.

The present tendency in the development of weapons is to build weapon systems provided with a continuously increasing mobility; this consideration applies to artillery weapons which have to be mounted on mobile platforms and operate in the first line of battle, such as automotive armored vehicles or towed chassis, so as to permit rapid displacement of these vehicles or platforms between successive points of shooting in order to give, for example, support to infantry units.

An artillery vehicle has to operate on different kinds of ground; consequently, the firing platform is subjected to an inclination which results from the local inclination of the ground. The inclination of the firing platform or, in other words, the non-verticality of the turret, when not compensated, leads to operational limitations in the use of the weapon.

A firing turret with two axes, of the elevational and azimuthal movement type, typically comprises: a means of anchoring on the firing platform; a mechanism for lateral aiming and, supported by this mechanism, an elevationally pivotable cradle on which the weapon is placed.

By construction, the pivoting axis of the cradle is perpendicular to the axis of the barrel of the weapon.

Any inclination of the firing platform results in an inclination of the pivoting axis of the weapon cradle which, in its turn, depends on the lateral aiming direction and on the direction on inclination of the platform. This angle of inclination of the pivoting axis of the weapon cradle is usually called the "tilt angle". The tilt angle causes a variation in the angle of lateral aiming of the arm when the aiming angle of the cradle is modified. In other words, the vertical plane containing the axis of the weapon, i.e. the shooting plane, is rotated when the inclination of the firing platform is modified.

To remedy the above-named fault, mechanisms for aiming or for driving aerial radar have been proposed, mounted on platforms, comprising a third axis, or tilt correction axis, between the axis of azimuthal movement and the axis of elevational movement. In this connection reference could be made to the book of W. M. Cady et al. "Radar Scanners and Radomes", Vol. 26 of the M.I.T. Series, edited by McGraw-Hill in 1948.

There are also known naval artillery mountings including a third axis intended for correcting the tilt of the trunnions of the weapon caused by the inclination of the ship. In the design of such mechanisms this third axis considerably reduces the strength of the mechanism and no means have been provided until now, which would permit the integration of the third axis in an armored firing turret which is also tight against bad weather.

There are further known armored vehicles in which a cradle which bears the barrel, its ammunition magazine and the seats occupied by the weapon operators, is suspended so as to be movable around an axis for correcting the tilt angle. In accordance with the proposed design of this aiming mechanism, its strength is considerably decreased, the wheel clearance of the trunnions is limited, the elevational displacement of the gun requires a second suspension point, and the means for protecting the tilt mechanism from enemy projectiles and from bad weather are extremely complicated.

OBJECT AND SUMMARY OF THE INVENTION

The object of the invention is to overcome the drawbacks of the existing aiming mechanisms provided with the above mentioned means for correction of the tilt angle.

The invention consists in a firing turret orientable around its axis and comprising means for assuring the horizontality of the pivoting trunnions of the weapon cradle and means associated therewith permitting the verticality of the optical-sighting device to be obtained.

In accordance with one feature of the invention, a disc concentrically disposed in a circualr opening provided in a lateral wall of the firing turret bears the pivoting cradle of the weapon and is controlled as a function of the verticality of the site.

In accordance with another feature of the invention, the connection between the disc and the circular opening includes means for supporting and for rotating the disc.

In accordance with a further feature of the invention, the disc bears the pivoting mechanism of the cradle of the weapon.

In accordance with another feature of the invention, the plane which contains the circular opening and the disc is advantageously inclined with respect to the horizontal.

In accordance with still another feature of the invention, the connections between the disc and the circular opening and between the disc and the barrel cradle include sealing means against bad weather and against penetration of pollution from the outside.

In accordance with a further feature of the invention, the central part of the disc comprises a rectangular opening and the weapon cradle has a cylindrical shape in order to permit efficient protection of the weapon operators.

In accordance with a further feature of the invention, the sighting device, provided at the side of the weapon, contains means for correcting the tilt angle and means for verticalization.

In accordance with a further feature of the invention, the sighting device includes a sighting telescope integrated in a goniometer.

Other features and advantages achieved by the present invention will become obvious from the detailed description which follows, and which has been made by way of illustration, but not limitation, in connection with the accompanying drawings, which represent various embodiments of a firing turret mounted on a mobile platform.

BRIEF DESCRIPTION OF THE DRAWINGS

FIGS. 11*a* and 11*b* represents schematically another embodiment of the device of FIG. 10;

DESCRIPTION OF THE PREFERRED EMBODIMENTS

Figure 1:
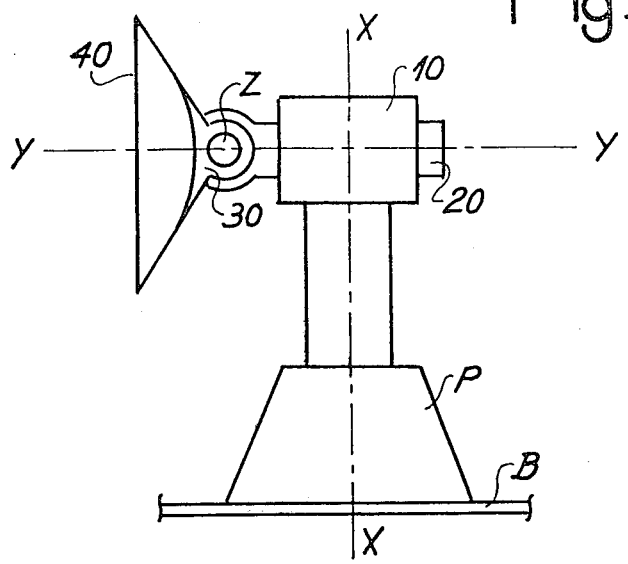
FIG. 1 represents the articulation means fo a turret having three axes.

FIG. 1 represents schematically a mechanism for aiming in azimuthal and elevational direction having a third axis permitting the horizontal maintenance of the elevational aiming axis.

The aiming mechanism with three axes comprises:

- a pedestal P, anchored on a platform or base B, whose inclination is susceptible to modification,
- a first element 10 orientable around an axis X,
- a second element 20 disposed inside the first element and freely turnable around an axis Y;
- a cradle 30, which can pivot around an axis Z, and is supported by the second element; on this cradle is attached a device 40, which it is desired to point in a given direction.

The two components of the inclination of the platform can be defined and measured along two orthogonal directions, a first component parallel with the direction of the axis Z and a second orthogonal component, by means of one or two sensors, responsive to the gravity of the specific site, and which deliver two signals, a first signal corresponding to the direction of the axis Z which is used for maintaining the axis Z horizontally and a second signal which can be used if necessary for correcting the error of aiming in elevation resulting from the inclination of the base.

Figure 2:
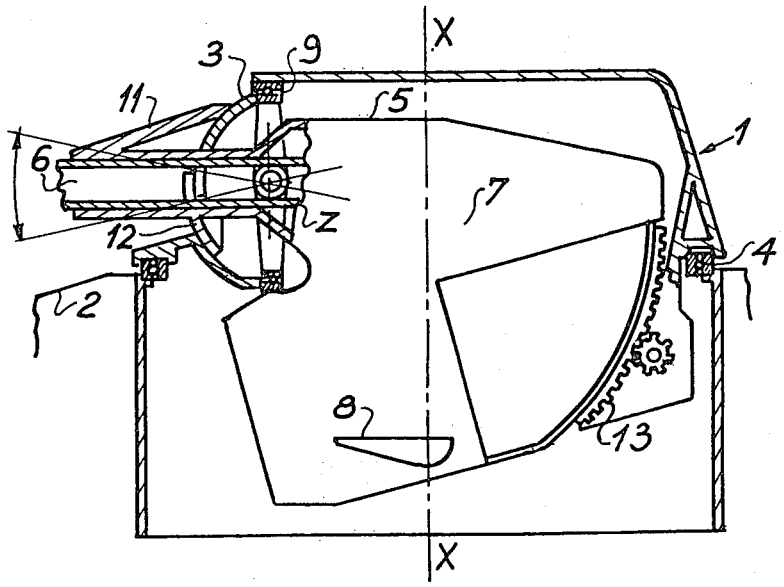
FIG. 2 represents, in accordance with the prior art, a firing turret in which the artillery weapon is suspended and movable around an axis for correction of the tilt angle.

FIG. 2 represents, in accordance with the prior art, a firing turret 1 having means for correcting the tilt of the weapon, mounted on an armored vehicle 2 not represented in the figure. The turret is orientable around its axis X and includes a ball bearing track 4 disposed for this purpose. The assembly comprising the gun 6, its ammunition magazine 7 and the seats 8 occupied by the weapon operators is suspended in cradle 5.

The cradle 5 pivots around an axis Z on trunnions fixed inside a ball bearing 9 vertically disposed in an opening provided in the turret, the axis Z being situated in the plane of the ball bearing. The pivoting of the suspended assembly is achieved by means of a rack mechanism 13 integrally formed with the firing turret and situated behind the ammunition magazine 7. The means permitting the protection of the operators sitting in the turret comprise, on the one hand, a convex and recessed cover 3 and, on the other hand, the elements 11 and 12 integrally formed with the cradle.

Figure 3:
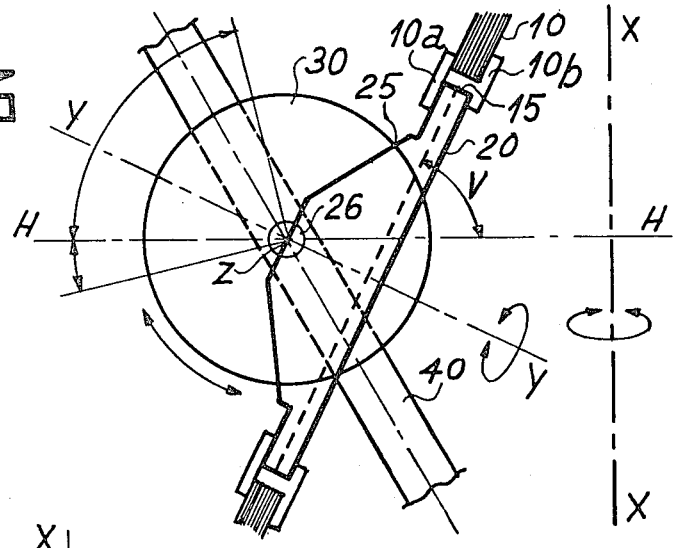
FIGS. 3, 3*a*, and 3*b* represents, in accordance with the present invention, the basic parts of a firing turret including an axis for the correction of the tilt angle of the trunnions of the weapon.
Figure 3A:
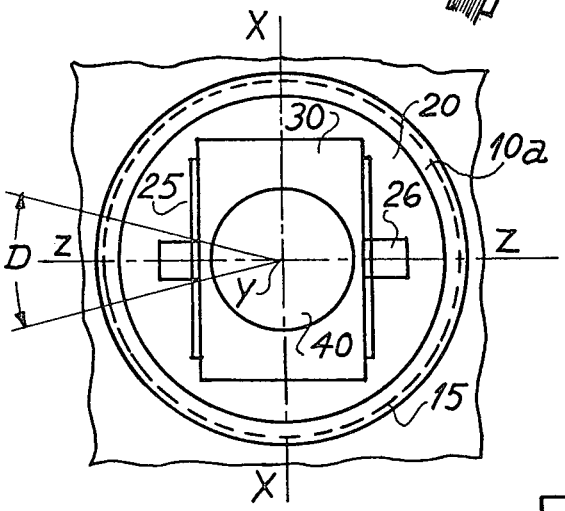
Figure 3B:
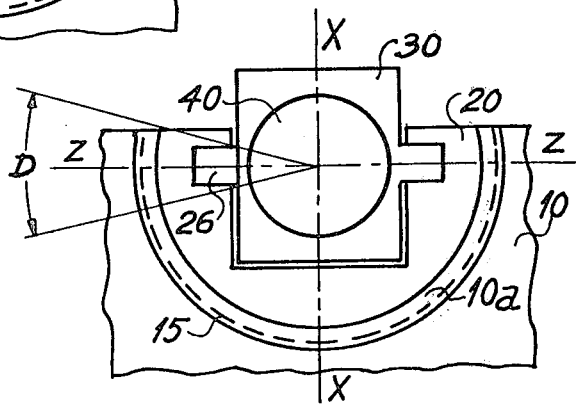

FIGS. 3, 3*a* and 3*b* represent schematically a firing turret in accordance with the invention; FIG. 3*a* represents a lateral view and FIG. 3*b* a front view of this turret which comprises the following elements:

- a panel 10 which may constitute the wall of the turret;
- a circular opening 15 having an axis Y, cut through the whole thickness of the panel 10;
- a circular element or disc 20 which is concentrically mounted in the circular opening 15. This circular element 20 can turn freely inside the circular opening 15; the central part of this disc comprises a rectangular opening 25;
- a cylindrical element 30 which constitutes the weapon cradle and is freely mounted in the rectangular opening 25 and includes pivoting means 26 around an axis Z. The barrel 40 of the weapon passes through this cradle.

The assembly thus formed is mounted on a platform which is capable of taking on an inclination of ±15° with respect to the horizontal.

The panel 10 may be oriented around the axis X by an aiming device capable of azimuthal movement, which is not represented in FIGS. 3, 3*a* and 3*b*. The disc can turn around the axis Y by an angle equal to the tilt angle D whose maximum value corresponds to the inclination angle of the platform. The pivoting angle of the weapon cradle, on site, can be on the order of 90° in view of the inclination of the platform which has to be considered when aiming the weapon in elevation.

The axis Z can be situated in the plane of the panel 10, behind it or in front thereof, as shown in FIG. 3, in order, for example, to guarantee the equilibrium of the weapon around the axis Z. The angular position of the disc 20 is manually or automatically adjustable to the verticality of the site; for this purpose it includes a level detector and a mechanism for movement around the axis Y. In addition, the disc supports a pivoting mechanism for the weapon cradle. These different elements, are not represented in the figure, and will be described below.

The means for supporting and rotating the disc 20 in the circular opening 15 may comprise, for example, two rings 10*a* and 10*b* attached at both sides of the panel in such a manner as to constitute a groove for housing the disc; the disc may be provided with means permitting assurance of the tightness of the disc/panel and disc/-cradle connections, as described below.

In accordance with another feature, the plane of opening may be advantageously inclined by an angle V with respect to the horizontal H. The means for turning the disc in the circular opening may recive, if necessary, an anti-friction treatment in order to reduce the frictional torque, especially in the case where the movement of the disc is automatically controlled.

FIG. 3*c* represents schematically a front view of an embodiment of a firing turret in accordance with the present invention. In accordance with this embodiment, the disc 20 and the circular opening 15 provided in said panel 10 are truncated above the pivoting axis of the weapon cradle 30. In this figure, for purposes of illustration, the pivoting axis Z of the weapon cradle is contained in the plane of the disc but, as mentioned above, this condition is not absolutely necessary.

The other means provided by the invention, namely, the means for adapting the disc to the verticality of the site and the mechanism for pivoting the weapon cradle, which is integrally mounted with the disc, remain unchanged.

One embodiment of the invention as well as the constructional details of the specific elements of the firing turret will now be described in more detail.

Figure 4A:
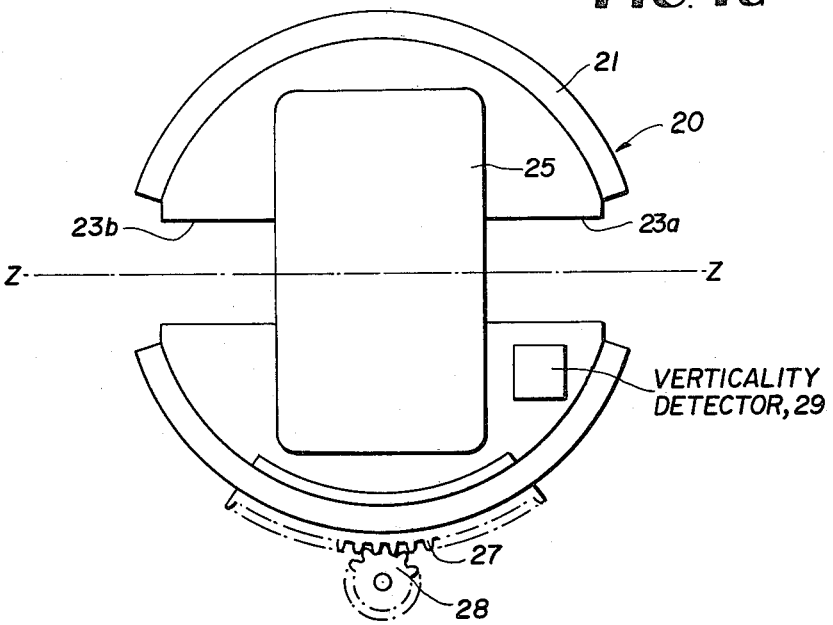
FIGS. 4*a* and 4*b* represents one embodiment of the disc for correction of the tilt angle, in accordance with the present invention.
Figure 4B:
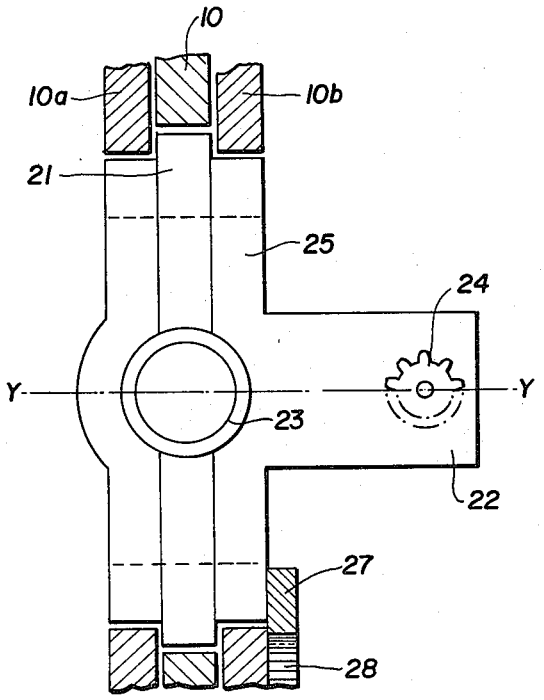

FIGS. 4*a* and 4*b* relate to FIG. 3 and represents one embodiment of the disc 20; FIG. 4*a* represents a lateral view and FIG. 4*b* a front view of this disc. In this embodiment the disc is flat and the axis Z of the trunnions 26 is substantially situated in the plane of this disc.

The disc 20 comprises:

- a smooth ring 21 which is housed in the rings or flanges 10*a* and 10*b* integrally mounted with the panel 10; this smooth ring can be cut away in the region of the axis Z in order to permit easier mounting of the pivoting means 26 of the weapon cradle,
- a rectangular opening 25 whose dimensions correspond to the dimensions of the weapon cradle,
- a toothed sector 27 which permits rotation of the disc around the axis Y manually or automatically by means of a pinion 28,
- a casing 22 which encloses the control mechanism of a pinion 24 intended for effecting the pivoting of the weapon cradle,
- two bearings 23*a* and 23*b* for receiving the pivoting trunnions 26 of the weapon cradle,
- a level detector 29 which delivers a signal indicating the horizontality of the bearings 23*a* and 23*b*.

The disc may be made of steel and its thickness depends mainly on the stresses to which the weapon is submitted and the desired effectiveness of the armor.

Figure 5A:
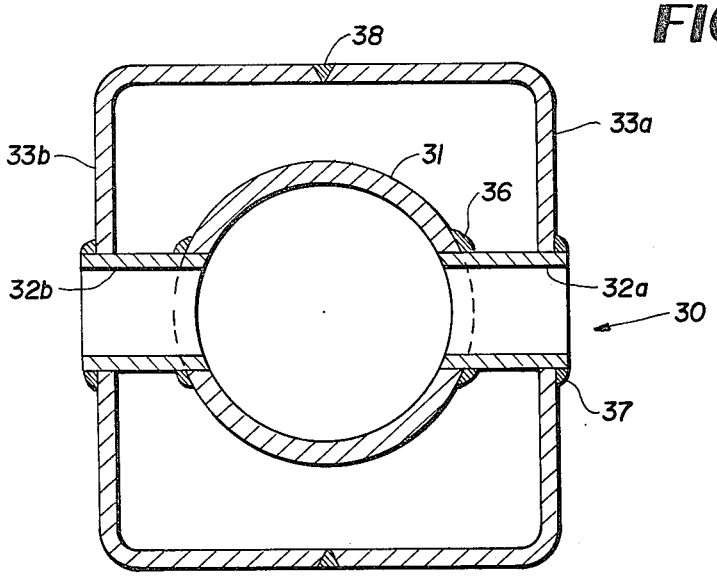
FIGS. 5*a* and 5*b* represents an embodiment of the weapon cradle in accordance with the present invention.
Figure 5B:
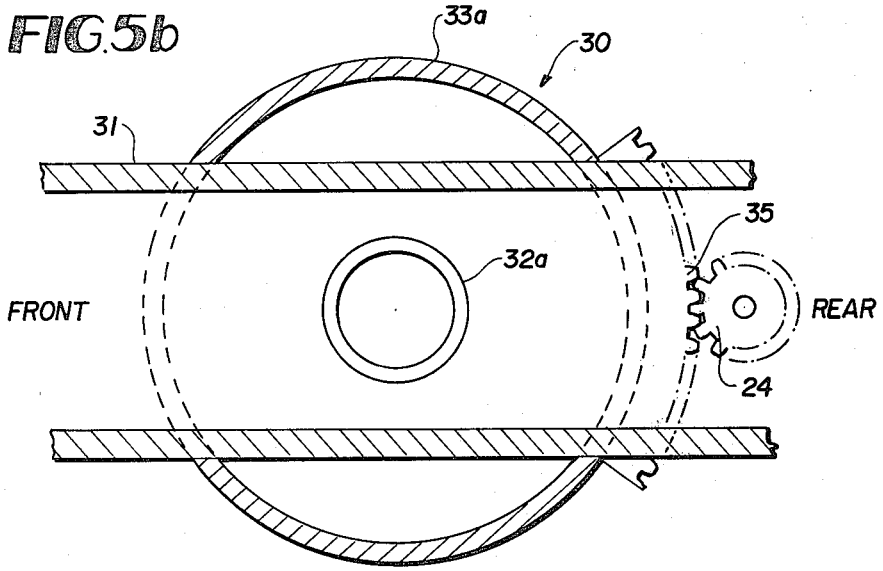

FIGS. 5*a* and 5*b* relate to FIG. 3 and represents an embodiment of the weapon cradle 30, FIG. 5*a* being a front view and FIG. 5*b* a lateral view of this cradle.

The weapon cradle consists of two elements:

- a first element 31 of tubular shape in which the barrel 40 of the weapon is placed and supported; on this element 31 are provided two bearings 32*a* and 32*b* inside which may be disposed the pivoting trunnions 26 of the cradle,
- a second element or mask 33, composed of two half shells 33*a* and 33*b* integrally formed with the first element 31; this second element is provided with a toothed sector 35 driven by a pinion 24, which in its turn is rotated by the pivoting mechanism of the cradle represented in FIG. 4*b*.

The bearings 32*a* and 32*b* may, for example, be attached to element 31 by a set of welds 36. The half shells 33*a* and 33*b* may be connected by a weld 38 and made integral with element 31 by a set of welds 37.

The dimensions of the cradle are governed by the caliber of the weapon.

Figure 6:
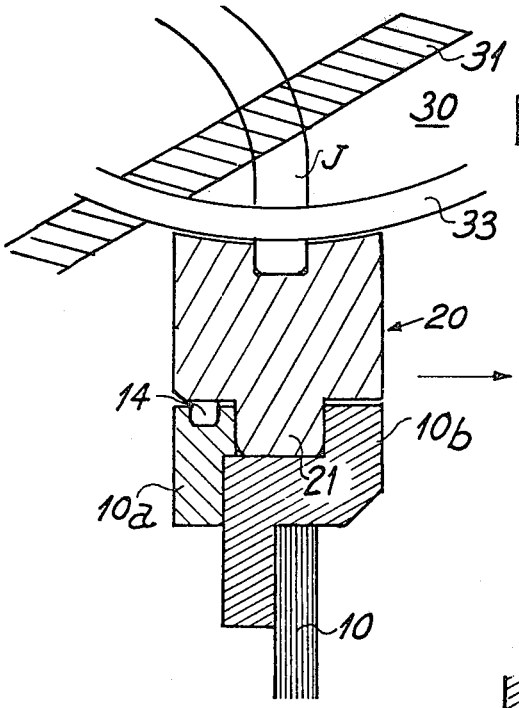
FIG. 6 represents details for the connection between the disc and the wall of the turret.

FIG. 6 represents the details of the connection between the panel 10 and the disc 20 shown in FIG. 3 and gives an example of an embodiment of a first means assuring the tightness of this connection between the disc 20 and weapon cradle 30; in this figure the arrow indicates the inside of the turret.

On the wall 10 of the firing turret is fixed a first ring 10*b* whose cross-section has an S-shaped profile in such a manner as to provide a strong support for the disc 20. After mounting the disc 20, a second ring 10*a* which constitutes a means for supporting the disc in position is fitted onto the first ring. The second ring has a seal 14 which constitutes the first tightness means. In addition, the combination of these two rings provides a means permitting the turning or rolling displacement of the disc 20. In the rim of the disc there is provided a groove which receives an inflatable gasket J constituting the second tightness means.

Figure 7:
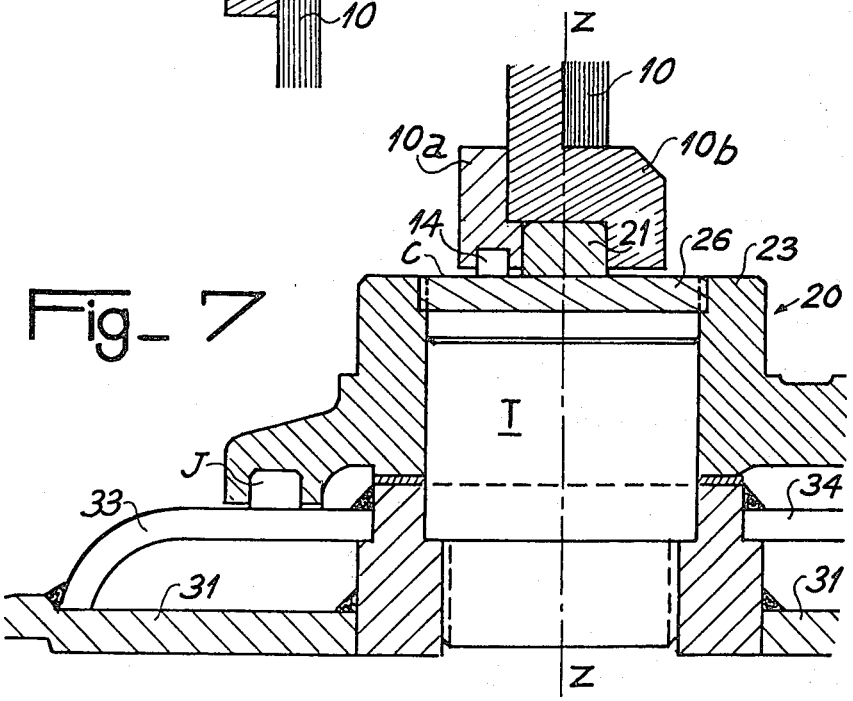
FIG. 7 represents details regarding the pivoting means of the weapon cradle.

FIG. 7 represents an embodiment of the means for pivoting the weapon cradle. As described previously, the tubular element 31 of the weapon cradle includes a set 32 of two bearings 32*a* and 32*b* (FIG. 5) and the disc 20 includes a set 23 of two bearings 23*a* and 23*b* (FIG. 4). Trunnions T are disposed inside these two sets of bearings and may, for example, be screwed into the set of bearings 32 and protected by covers C. In the region of the bearings the inflatable gasket J extends from these latter due to a set-off in the housing groove of this gasket.

Figure 8:
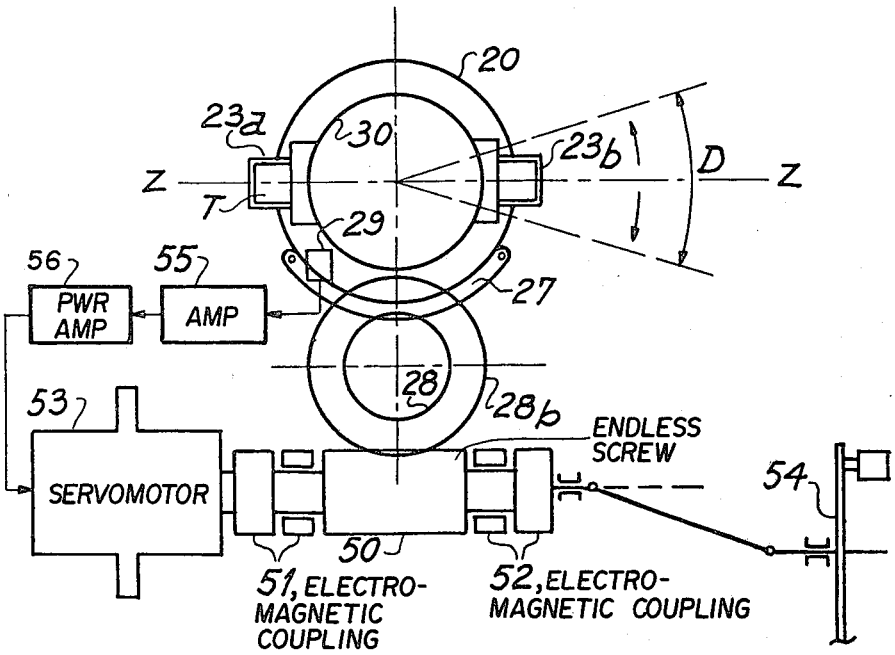
FIG. 8 represents schematically the means permitting control of the disc as a function of the verticality of the specific site.

FIG. 8 represents schematically an embodiment of the adapting mechanism which permits assuring the horizontality of disc 20, i.e., more specifically, the horizontality of the pivoting axis Z of the cradle 30. The weapon cradle 30 is shown with its trunnions T disposed on bearings 23*a* and 23*b* of disc 20. The disc is provided with a toothed sector 27 whose arc is at least equal to the tilt angle D.

The toothed sector is driven by a pinion 28 integrally built with a tangential wheel 28*b*, this latter being rotated by an irreversible endless screw 50. The endless screw has two axis of entry which can be driven by electromagnetic couplers (51 and 52), on the one hand by a servomotor 53, and on the other hand by a manual handle 54, which constitutes a spare system of actuation in case of emergency.

Disc 20 is provided with either a level detector 29 or verticality indicator of the "bubble" or "plumb-line" type, for example. The error signal delivered by the level detector 29 is amplified by an amplifier 55 comprising electrical corrector grids. The outlet signal of this error amplifier is supplied to a power amplifier 56 which supplies the motor 53. The theory of servomechanisms is sufficiently familiar to one skilled in the art, and there should therefore be no major difficulties in defining the characteristics, and producing the elements of the servo loop, as soon as the values of the main parameters such as inertia, time of response, and precision of the correction of the tilt angle are established.

Figure 9A:
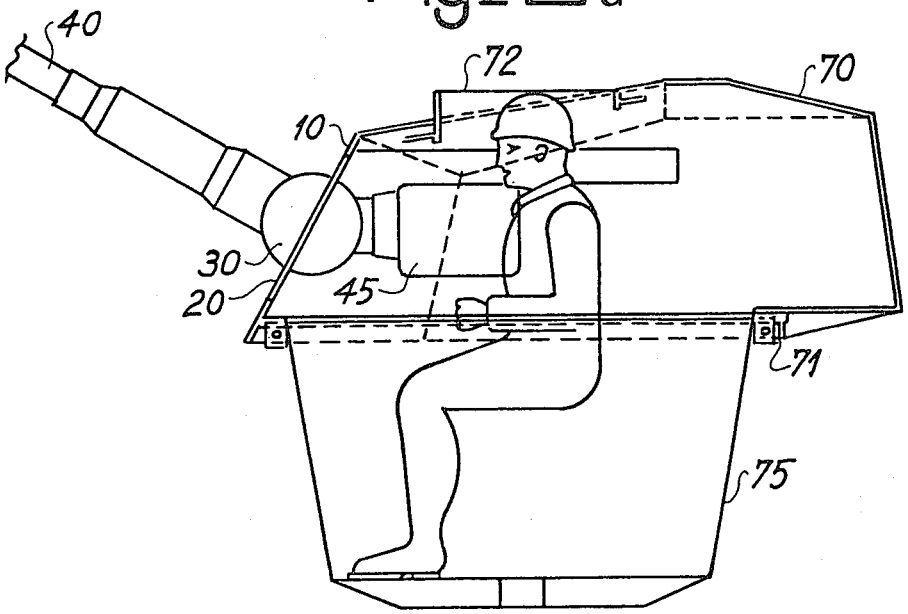
FIG. 9 represents a general view of the firing turret.
Figure 9B:
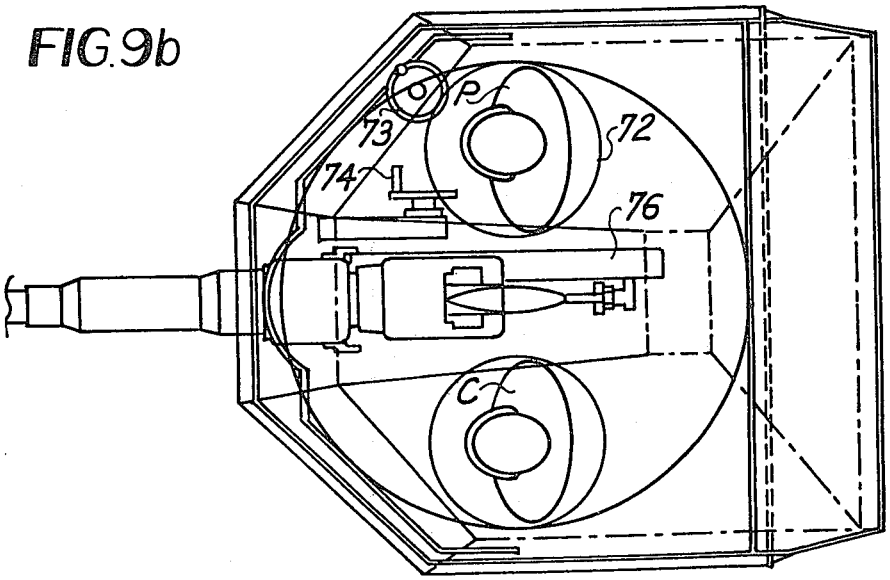

FIGS. 9*a* and 9*b* represents a firing turret, according to the present invention, adapted to an automotive or trailed vehicle. FIG. 9*a* represents a lateral view of the turret and FIG. 9*b* a top view.

The turret comprises two integral parts: an upper part 70 or cupola, which emerges on top of the vehicle and a lower part 75, or basket, which is situated inside the vehicle. Such a turret can be azimuthally oriented over 360° by means of a rolling track 71. The range of aiming in elevation can reach 70° upwards and 10° to 15° downwards, while the corrected tilt angle can easily be ±15°

.

the wall 10 which supports the disc 20 for correcting the tilt, forms an integral part of the cupola and the details of these elements, which have been described before, are not shown in this figure. The cradle 30 and the barrel 40 of the weapon are represented in upward pointing position, while the breech 45 of the weapon is shown in horizontal position.

The turret is served by two operators: a gunner P and a loader C. The roof of the cupola 70 comprises, at least in the vicinity of the gunner, an opening 72 in which is situated an optical sighting device which will be described in detail below. The controls for azimuthal aiming 73 and vertical aiming 74 are shown in FIG. 9*b*, and the ammunition magazine is placed, for example, behind the two operators. The loading and ammunition supply device 76, which does not form part of the present invention, will not be described.

We shall now describe the means permitting the assurance of the verticality of the optical sighting device, in spite of the inclination of the firing platform. The optical sighting device comprises a cradle supporting optical means.

The firing turret operator who is assigned to carry out the sighting sits on a seat integrally made with the turret, next to the weapon. The optical sighting device is disposed with respect to the place where this gunner sits in such manner that the upper part thereof communicates through the roof of the cupola with the outside, while the lower part thereof has an eye piece situated at the level of vision of the gunner.

The firing turret must permit two types of firing: flat-trajectory firing and curved-trajectory firing. The optical sighting device must have two different optical elements, possibly integrated in a single unit, namely:

- a firing telescope which is integrally mounted with the barrel of the weapon and moves simultaneously with the elevational and azimuthal movements of the weapon; this device includes a micrometer which can take into consideration the external ballistic features of the projectile,
- a goniometer for vertical aiming; this apparatus must be integral with the barrel in azimuthal direction and its head, of the panoramic type, must permit the sighting of natural or artificial geographic reference points, this goniometer being of the simple or of the double platform type.

Figure 10:
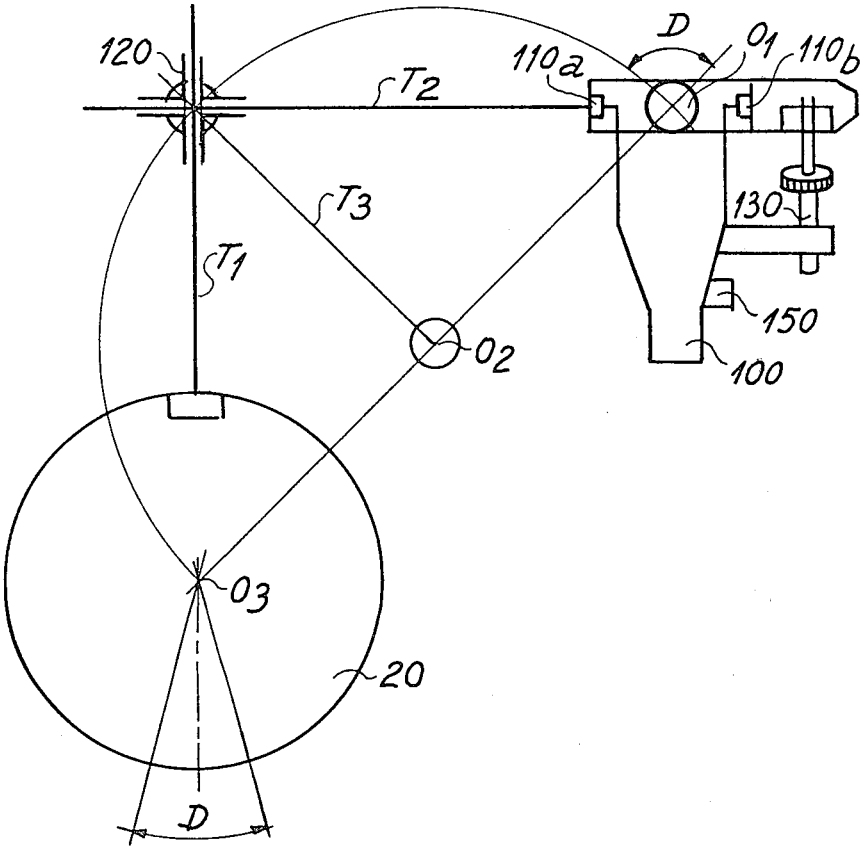
FIG. 10 represents schematically the means for permitting verticalization of the sighting device.

FIG. 10 represents schematically the means permitting to verticalize the cradle 100 of the sighting device. The cradle 100 is freely turnable, on the one hand around a fixed point $0_1$ by an angle equal to the tilt angle D and, on the other hand, along an orthogonal direction around the bearings 110*a* and 110*b*. The disc 20 which supports the weapon cradle is adapted to the verticality of the site as described earlier.

The rotation of the cradle 100, by a tilt correction angle corresponding to the angle for correction of the tilt of the disc 20, is achieved by a reproducing mechanism comprising:

- a first rod $T_1$ integrally made with the disc 20,
- a second rod $T_2$ integrally made with the cradle 100,
- a cross 120 made up of two adjacent tubular segments.

The rods $T_1$ and $T_2$ can freely slide inside the tubes which constitute the cross 120. In order to make the reproducing mechanism rigid and, if necessary, reduce the effect of the mechanical play of the cross, a third rod $T_3$ can be inserted between the cross and a bearing situated at a fixed point $0_2$. The configuration of the mechanism, as represented in FIG. 10, is inscribed in a half circle; however, it is possible to choose a different configuration in which the point $0_2$ is at the center of the circle, the straight line $0_3$, $0_1$ is a secant of the circle and the angle formed by the tubes of the cross is other than 90°.

The cradle 100 which can support the optical elements of the sighting device is provided with a level detector 150, for example a detector of the bubble type, and with a micrometric control screw 130, in order to permit the gunner to verticalize the sighting device in a plane perpendicular to the tilt plane.

FIGS. 11*a* and 11*b* represent schematically one embodiment of the means for verticalization of the stand or optical sighting device. This means comprises a support plate 250 of the cradle of the sighting device, said plate being freely turnable around a point $0_1$ connected to the wall (10) of the firing turret, or more exactly its cradle or support, can pivot around a point $0_2$ in order to permit adjustment of the verticality of the optical axis AA' of the sighting device by a quantity $\theta$ which is at least equal to the maximal tilt angle D of the turret.

The disc 20 which supports the weapon cradle (not represented) is adapted to the verticality of the site as described earlier. This disc, which bears a toothed sector 27, is rotated around its principal axis $O_D$ by a servomechanism principally comprising a motor 53 and an endless screw 50. One end of this endless screw moves a pinion mechanism 200 whose mechanical outlet axis actuates a threaded rod 210 fitted into a threaded element 220 which can slide, without turning, in a sleeve 225; the end of the threaded rod 210 has a bar 230 coupled to the plate 250 by a roller 240. The cradle or support which bears the optical elements is provided with a level detector and with a micrometric adjustment screw as described before, in order to permit the gunner to effect the verticalization operation of the optical sighting device in a plane perpendicular to the tilt angle.

Figure 12:
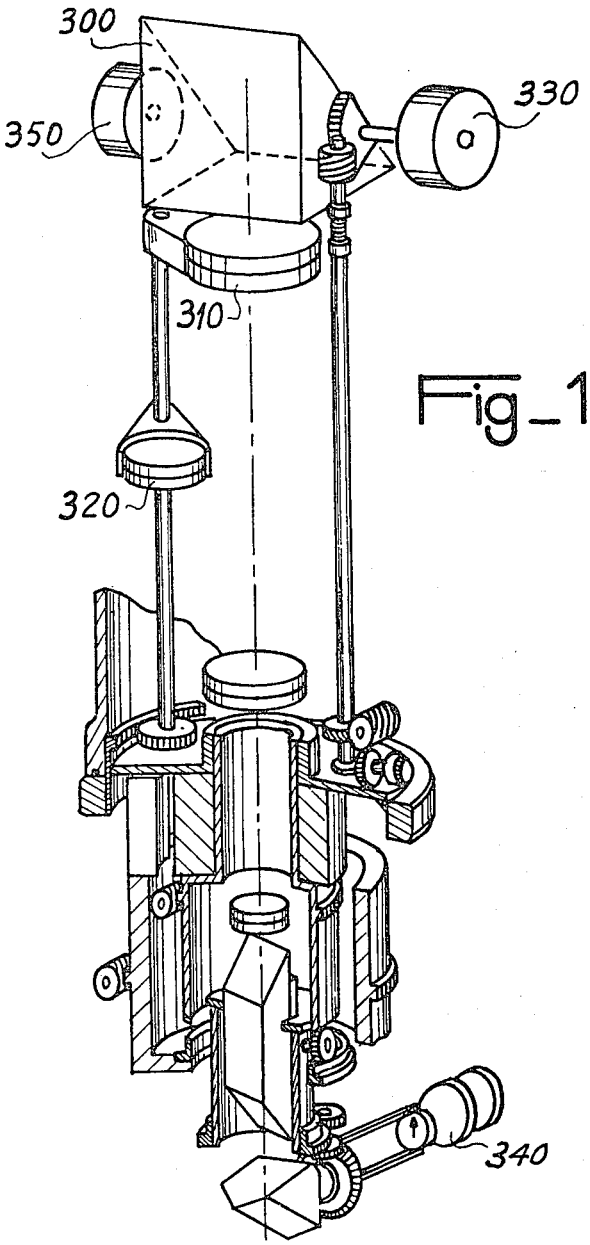
FIG. 12 represents the optical means of the sighting device.

FIG. 12 represents a cut-away view of the optical means of a sighting device in which the sighting telescope is integrated with the goniometer. The fact that the two functions, namely, sighting via a geographical reference point and sighting via the objective, are grouped in a single apparatus has the following advantages:

- the placement of the sighting device inside the restricged volume situated in front of the gunner is facilitated;
- the means for verticalization of the sighting device are simplified;
- the gunner uses a single eye piece.

The optical means of the sighting device comprise more specifically a single eye piece 340, interchangeable objectives 310 and 320 which permit modification of the optical enlargement and a head prism 300 articulated around its axis. When the telescope functions, this head prism is adapted to the elevational direction of aiming of the barrel. For this purpose an angular transducer is mounted at the end of the axis of the trunnions of the weapon cradle and an equivalent transducer 350 associated with a servomotor 330 are mounted on the rotation axis of the head prism. The other elements constituting the optical means of the sighting device which do not form part of the present invention shall not be described.

The invention as described above has, in addition to the advantages already mentioned, the further advantage of providing a compactly built firing turret and permitting a perfect coordination between the sighting of the target and the aiming of the weapon.

The invention is not limited to the embodiment described and can include other embodiments. For example, the means for housing the disc in the circular opening provided in the vertical wall of the turret may be carried by the disc itself; the servomechanism of the disc may be of the hydraulic type; and the mounting of the trunnions of the weapon cradle can be inverted.

A firing turret in accordance with the present invention may be borne by a combat vehicle or an artillery vehicle of the armored or non-armored type.

I claim:

1. A 360° orientable firing turret for assembly on a mobile platform, said turret comprising a cupola which includes a roof, and a circular opening in one side of said cupola from which a gun barrel extends, a gun barrel cradle for mounting said gun barrel in said cupola and trunnions for supporting said gun barrel cradle and means operative relative to said trunnions for correcting any tilt angle of said trunnions relative to a site wherein the means for correcting the tilt angle of said trunnions comprise:

a disc having a central opening, said barrel cradle being encased in said central opening in said disc.

a ring concentrically disposed in said circular opening provided in said cupola, said disc including a track rotatably mounted in said ring, a toothed sector disposed on said disc, a servo-motor for rotating said disc according to a vertical disposition of said site and a mechanism related to said gun barrel cradle for pivoting said gun barrel cradle in elevation, a sighting device mounted within said cupola on a side wall of said cupola, said sighting device being mechanically coupled to said servo-motor and said sighting device includes an optic input which crosses through an opening provided in said roof of said cupola.

2. A firing turret according to claim 1, wherein the disc is a flat disc.

3. A firing turret according to claim 1, wherein the disc is a convex disc.

4. A firing turret according to claim 1, wherein the principal axis of the disc may be inclined with respect to the horizontal.

5. A firing turret according to claim 1, wherein the disc has a mechanism for elevational pivoting of the weapon cradle.

6. A firing turret according to claim 1, wherein the disc is provided with a means for determining the verticality of the site.

7. A firing turret according to claim 1, wherein the disc is provided with a means permitting its positioning in accordance with the verticality of the site.

8. A firing turret according to claim 1, wherein the central opening of the disc has a sealing means.

9. A firing turret according to claim 8, wherein the sealing means of the opening is an inflatable gasket.

10. A firing turret according to claim 1, wherein the opening provided in the lateral wall of the turret has a sealing means.

11. A firing turret according to claim 10, wherein the sealing means of the opening is a toroid gasket.

12. A firing turret according to claim 1, wherein the disc and the circular opening are truncated at their upper portion.

13. A firing turret according to claim 1, in which the aiming of the weapon is assured by an optical sighting device placed in a cradle which can pivot in elevation, characterized in that it includes a means permitting the integration of the cradle of the optical sighting device and the disc which bears the weapon cradle.

14. A firing turret according to claim 13, wherein the means permitting the integration of the cradle of the optical sighting device and the disc comprises a set of articulated rods.

15. A firing turret according to claim 13, wherein the means permitting the integration of the cradle of the optical sighting device and the disc comprises a sliding rod which is driven by the rotation mechanism of the disc.

* * * * *